United States Patent [19]

Mathews

[11] 4,371,994

[45] Feb. 8, 1983

[54] ROTATIONAL INDEXING NOZZLE ARRANGEMENT

[75] Inventor: Lester R. Mathews, 9810 N. 37th St., Phoenix, Ariz. 85028

[73] Assignees: Lester R. Mathews; Lucien Warner, both of Phoenix, Ariz.; Water Circulation Patents, Inc., Syracuse, N.Y.

[21] Appl. No.: 155,042

[22] Filed: Jun. 2, 1980

[51] Int. Cl.[3] ..... E04H 3/16; E04H 3/18; E04H 3/20

[52] U.S. Cl. ..... 4/490; 134/167 R; 134/168 R; 239/206; 4/492

[58] Field of Search ..... 4/490, 492, 496, 507; 210/169.7; 134/167 R, 168 R, 10; 239/5, 6, 200, 206

[56] References Cited

U.S. PATENT DOCUMENTS

| | | | |
|---|---|---|---|
| 3,045,829 | 7/1962 | Rule et al. | 210/169 |
| 3,247,969 | 4/1966 | Miller | 210/169 |
| 3,408,006 | 10/1968 | Stemwood | 134/167 R X |
| 3,506,489 | 4/1970 | Baker | 134/10 |
| 3,521,304 | 7/1970 | Ghiz | 4/490 |
| 3,675,252 | 7/1972 | Ghiz | 4/490 |
| 3,702,173 | 11/1972 | Reynolds | 239/204 |
| 3,747,858 | 7/1973 | Krynicki | 239/204 |
| 3,770,203 | 11/1973 | Dyan | 239/205 |
| 3,940,066 | 2/1976 | Hunter | 239/204 |
| 4,019,686 | 4/1977 | Palma | 239/205 |
| 4,026,471 | 5/1977 | Hunter | 239/206 |
| 4,188,673 | 2/1980 | Carter | 4/490 X |
| 4,322,860 | 4/1982 | Gould | 4/490 |

*Primary Examiner*—Henry K. Artis
*Attorney, Agent, or Firm*—Charles E. Cates; Victor Myer

[57] ABSTRACT

A rotational indexing nozzle arrangement has been devised wherein positive and consistent indexing action takes place under the influence of the application of fluid pressure and its relief by the action of an indexing or biased spring which becomes relaxed during the first stage (outward) movement of the indexing of the rotational nozzle head and which bites in and holds thereby causing the nozzle head to rotate during the second stage (inward) movement of the discharge head. The extent of the incremental indexing is determined by the length and angle of the biasing spring, or member. For improved operation a bearing of the ball or roller type may be disposed at the inward end of the nozzle arrangement whereby the resistance of the closing spring to rotation of the nozzle head is lessened.

11 Claims, 8 Drawing Figures

ROTATIONAL INDEXING NOZZLE ARRANGEMENT

RELATED APPLICATION

This application is related in its subject matter to that application of the same inventor Ser. No. 082,182, filed Oct. 4, 1979, now U.S. Pat. No. 4,271,541, entitled "Apparatus for Intermittent Delivery of Fluid Under Pressure".

BACKGROUND OF THE INVENTION

This invention relates to nozzle arrangements for fluid delivery heads which, for example, may be of the pop up variety whether used in swimming pools, lawn sprinklers, or the like, wherein it is desired to rotationally index the nozzle head intermittently with the application of fluid, for example, liquid pressure. During the intermittent operation the stream of liquid flowing from the nozzle opening covers the full circumference or any desired part of the area involved. It is an object of the invention to provide an improved rotational indexing nozzle arrangement of this character.

Indexing nozzles, or similar apparatus, are known to the prior art, and specifically are known in the applicant's co-pending application above referred to. Reference may also be made in this connection U.S. Pat. No. 3,408,006 Stanwood issued on Oct. 29, 1968 and entitled "Liquid Jet Producing Device". In the applicant's co-pending application indexing is achieved by virtue of the liquid under pressure flowing through diagonally disposed passageways which flow causes the nozzle component to rotate. At the same time, the force of the liquid causes the nozzle head to pop up, and when it has rotated sufficiently engagement between appropriate surfaces takes place and rotation of the nozzle is stopped. In the Stanwood patent the application of fluid pressure likewise causes the nozzle head to pop up against the force of an appropriately placed spiral spring and when the fluid pressure is cut off the nozzle head recedes to its rest position. In so doing, appropriate cam surfaces interengage and cause the nozzle head to rotate by a specified amount.

In the prior art devices, particularly those referred to above, operation has not been totally satisfactory. In a structure according to the applicant's application. Ser. No. 082,182, relatively erratic dwell time in the rotational indexing of the sprinkler heads is achieved on occasion. Possibly this is due to time or pressure variations in the pipe or plumbing network feeding the sprinkler nozzles. In the Stanwood U.S. Pat. No. 3,408,006 the mechanism for causing indexing of the rotational nozzle head is relatively complicated and also subject to erratic performance. The latter may occur because of the cam surfaces involved which may become encrusted with rust or other deposits from the water, particularly from the chemicals involved in maintaining swimming pools, or the like.

Accordingly, it is a further object of the invention to provide an improved rotational indexing nozzle arrangement which overcomes the defects of the prior art devices and the environments wherein such devices are used.

SUMMARY OF THE INVENTION

It is a further object of the invention to provide an improved rotational indexing nozzle arrangement wherein the indexing is positively controlled and is definite in amount during each operation.

In carrying out the invention according to one form there is provided a rotational indexing nozzle arrangement adapted to be disposed in a conduit for supplying fluid under pressure comprising a discharge head moveable between two positions, one position under the influence of the fluid pressure and another position under the influence of spring means when the fluid pressure is relieved, a support member for the discharge head, and resilient bias means between the discharge head and the support member for indexing the discharge head responsive to movement thereof in one direction under the influence of the fluid pressure and in the opposite direction under the influence of the spring means on relief of the fluid pressure.

In carrying out the invention according to another form there is provided a rotational indexing nozzle arrangement adapted to be disposed in a conduit for supplying fluid under pressure comprising, a housing having a discharge end and being adapted to be disposed inside of such conduit, the housing including a support member having a central opening and two sides, a hollow stem having first and second ends slidably disposed in the central opening, a discharge head attached to the first end of the hollow stem adjacent the discharge end of the housing, abutment means at the second end of the hollow stem, first spring means between the abutment means and one side of the supporting member and rotational indexing means responsive to the motion of the discharge head away from and toward said support member disposed between the other side of the support member and the under side of the discharge head for rotating the discharge head a predetermined amount upon each movement of the discharge head.

The rotation of the nozzle is facilitated by the provision of a roller bearing at the abutment end of the hollow stem. The indexing mechanism conveniently may comprise a flexing spiral spring angularly disposed between the nozzle head and the supporting structure. The amount of rotational indexing may be controlled by controlling the length of the flexing spring.

BRIEF DESCRIPTION OF THE DRAWINGS

For a more complete understanding of the invention reference may be had to the accompanying drawings in which.

DESCRIPTION OF THE PREFERRED EMBODIMENTS

Figure 1:
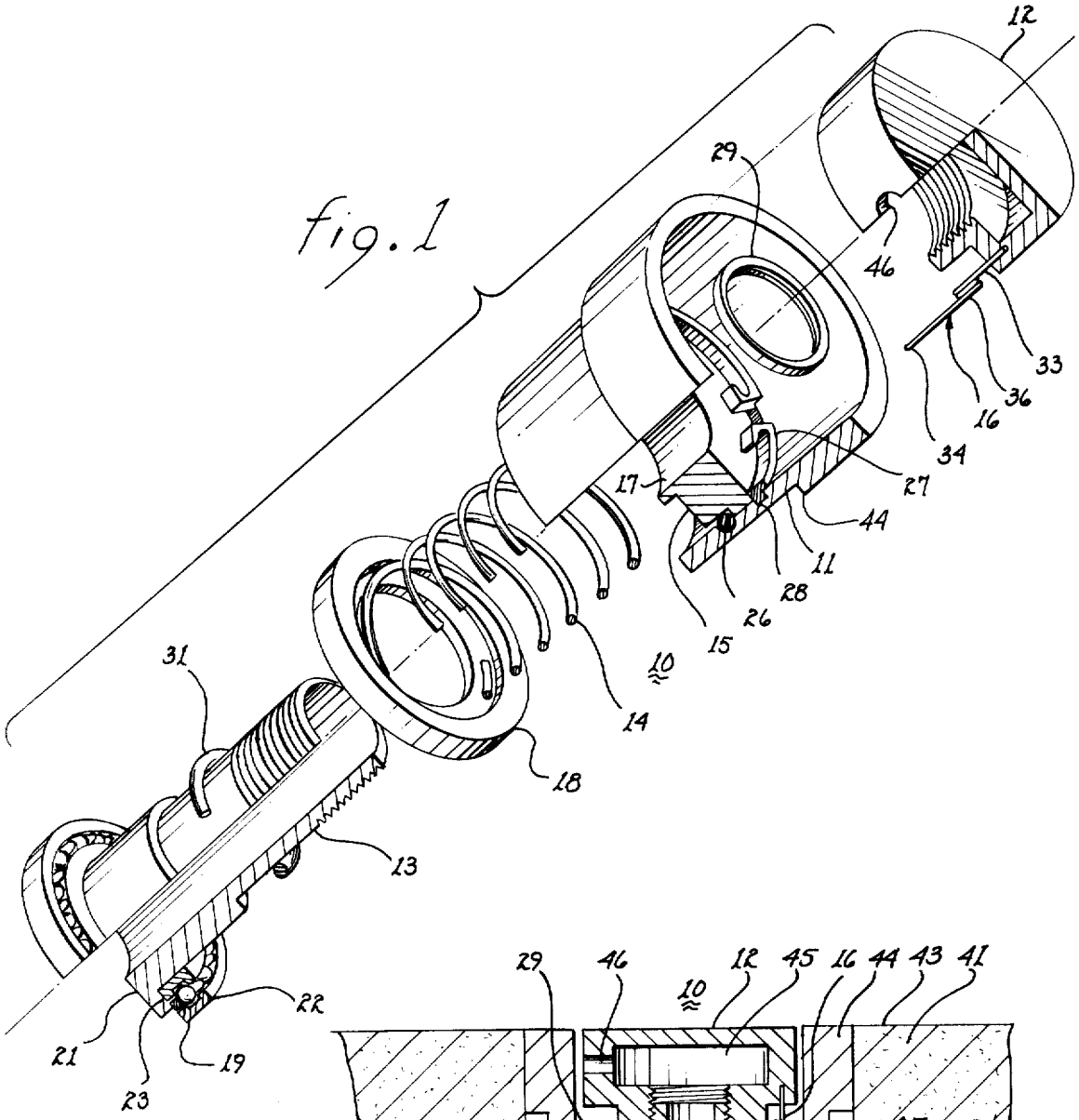
FIG. 1 is an exploded perspective view, partially in section, disclosing a rotational indexing nozzle arrangement according to the invention.

Referring to the drawings, there is shown a rotationally indexing nozzle arrangement 10 according to the invention comprising a housing 11, a discharge head 12, a hollow stem 13, a return spring 14, a supporting member or seal plate 15, and an indexing spring member 16.

Figure 2:
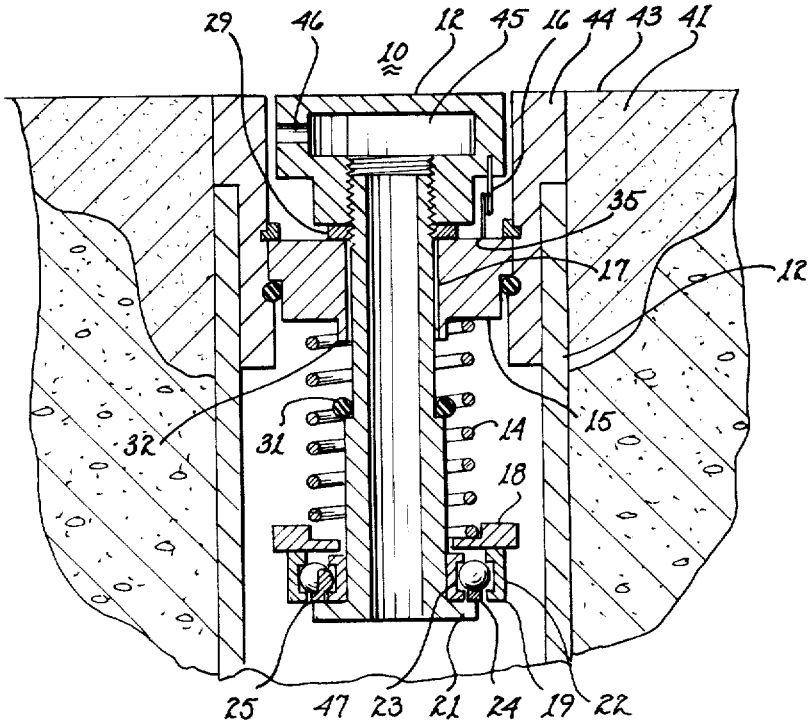
FIG. 2 is a sectional view of the indexing nozzle arrangement shown in FIG. 1 in one of its positions, namely, when fluid pressure is absent.

Referring to FIG. 2, the area of the nozzle arrangement above the seal plate 15 may be referred to as the discharge end and the area below the seal plate as the inlet end.

The parts described and certain other parts to be subsequently described are assembled together as may be observed in FIGS. 1 and 2 wherein the parts are shown during one condition of operation of the nozzle arrangement, that is to say when the fluid pressure is off. Thus, the discharge head 12 is screwed onto the upper end of the hollow stem 13 which projects through a central opening 17 in the seal plate 15, the spiral return spring 14 surrounds the hollow stem 13 on the inlet side of the seal plate and extends between the inlet side of the seal plate and the flange of an annular ring, or collar, 18 which bears against a bearing 19. The bearing 19 in turn bears against a flange 21 forming one end of the hollow stem 13, and it may be seen that the spring 14 forces the hollow stem 13 and thus the discharge head 12 downwardly into a recessed position in the absence of fluid pressure.

The collar 18, the bearing 19 and the flange 21 form part of an abutment structure against which one end of the spiral spring 14 bears in holding the nozzle assembly in its downward or off position. The bearing 19 is part of a preferred form of the invention and may in some embodiments be eliminated. The presence of the bearing 19, however, enables the hollow stem 13 and the attached discharge head 12 to easily rotate as will be more fully described. The bearing 19 includes an outer race 22 the upper edge of which bears against the underside of collar 18 and an inner race 23 which is annular in form and is relatively firmly received by the lower end of the hollow stem 13, the under side of race 23 bearing against the flange 21. The bearing 19 also includes a series of balls, rollers, or the like 24 held in a spider framework 25. The inner race 23 is firmly and nonrotatably received by the lower end of stem 13 and the race 22 has such dimensions, as may be seen in FIG. 2, that the collar 18 bears against the upper edge of this race without at the same time engaging or touching the inner race. Thus, the frictional resistance to rotation of the hollow stem 13 is substantially reduced, if not eliminated, by the presence of the bearing 19 when the hollow stem attempts to and does rotate, as will be described.

The seal plate 15 is held inside of the housing 11 between an "O" ring seal 26, or gasket, which bears against a shoulder on the inside of the housing 11 and a split ring retaining ring 27 at the discharge side of the seal plate, the outer circumference of the retaining ring 27 being received in a groove 28 also formed in the inner wall of the housing 11. A threaded retaining washer 29, or the like, is threaded over the upper end of the hollow stem 13 and serves to hold the hollow stem 13 assembled to the structure. If the discharge head 12 is unscrewed from the stem 13, the stem will remain in position by virtue of the retaining washer 29. Between the inlet side of the seal plate 15 and the collar 18 there is a further "O" ring seal member 31 received against a shoulder as shown on the stem 13. When the nozzle head 12 is in its discharge position, as when fluid pressure is being exerted against the inlet side the nozzle structure as may be seen best in FIG. 3, the "O" ring 31 bears against the depending extension 32 of the seal plate 15. This seals the fluid pressure away from the outward or discharge area of the nozzle arrangement, while at the same time the "O" ring seal member 26 prevents the leakage of pressure around the outer most circumference of the seal plate 15.

Disposed between the under side of the discharge head 12 and the adjacent surface 35 of the seal plate 15 there is disposed the indexing spring 16. The end 33 of the spring 16 is engaged and relatively firmly received in an appropriate hole in the discharge head 12 adjacent the circumference while the other end 34 extends freely and is disposed to engage the upper surface 35 of the seal plate 15 as may be visualized best in FIGS. 2-6. The spring or bias member 16 includes, in a preferred form, a spiral spring portion 36 from which the ends 33 and 34 extend. In the down or off position of the discharge head, as seen in FIG. 2, the spiral spring 16 is compressed, so to speak, and biases the discharge head 12 outwardly, but no movement takes place because of the predominance of the spring 14.

The various parts of the nozzle arrangement may conveniently be formed of any suitable material such as the synthetic nylon formed to the appropriate shapes and dimensions, the conduit 42 may be polyvinyl chloride, the springs may be of suitable metals which will not corrode in the presence of chlorinated and acidified water as is present in swimming pools, for example, and the various sealing members may be formed of any of the well known silicone type of materials. In the assembled form the nozzle arrangement 10 is disposed in a suitable opening which may be formed in the walls 41 of a swimming pool which also includes a pipe or supply conduit 42 that may be embedded into the walls of the swimming pool. The conduit 42 may terminate short of the surface 43 of the swimming pool wall to provide a somewhat larger diameter opening for receiving a lip 44 forming part of the housing 11. The housing 11 including the lip 44 may be cemented in position inside of the conduit 42 and the swimming pool wall.

Figure 3:
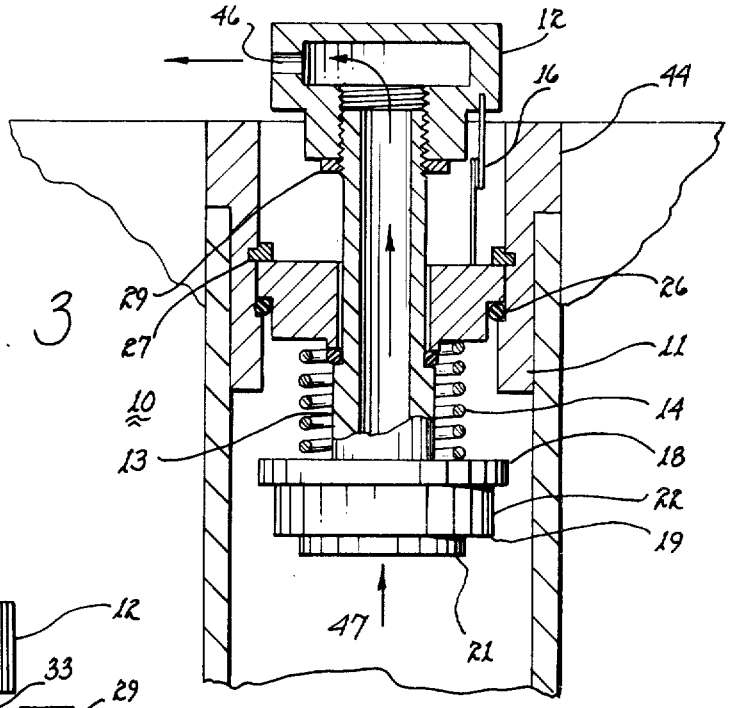
FIG. 3 is a view similar to FIG. 2 but showing the nozzle in its second position of operation, namely, when fluid pressure is present.

The inside of the nozzle head 12 is a hollow space 45 which communicates with the hollow inside of the stem 13 and a bore or discharge hole 46 communicates with the hollow space 45 and the exterior of the nozzle head 12, thus fluid, for example water, in the case of a swimming pool application, flows upwardly through conduit 42, through the hollow inside of stem 13 and out through the space 45 and bore 46 when the discharge head is in its upward position as seen in FIG. 3.

Figure 4:
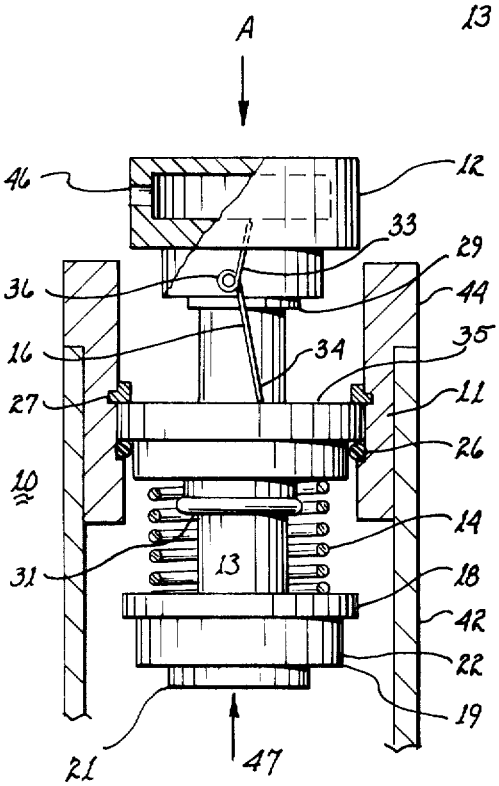
FIG. 4 is a sectional view similar to FIG. 3 in which the nozzle has been rotated to illustrate further functioning.

The operation of the nozzle apparatus is controlled by the pressure of the fluid, and its absence or relief. The indexing of the discharge head, together with the operation, may be understood more fully by considering FIGS. 2, 3, 4, 5 and 6. In the absence of fluid pressure at the inlet 47 to the nozzle apparatus, the discharge head 12 and the associated structure is in the downward position as shown in FIG. 2 caused by spring 14. In this position the indexing spring 16 is compressed as may be seen in FIGS. 2, 5 and 6. Under the influence of fluid pressure at the inlet 47 the discharge head 12 and the connected components move upwardly, the pressure being exerted against the lower edge of the stem and flange 21 and the upper surface of the hollow space 45 of the discharge head. In the upper position as shown in FIGS. 3 and 4, the spring 14 is compressed and the indexing spring 16 is extended and the bore 46 is directed outwardly so that water, or other fluid, may flow from the inlet 47 to and through the bore 46. The stream, or jet, of water, for example, coming out of the bore 46 may be used to circulate dirt and the like lying on the floor of the swimming pool and keep it in suspension so that the pool filtering system may move it. In this motion the spiral spring 16 relaxes to a substantial extent, if not totally, but the discharge head 12 moves essentially upwardly without any particular rotational movement. The discharge head 12 stays in the location shown in FIG. 3 so long as fluid pressure is applied at inlet 47 in the particular instance.

Comparing FIGS. 3 and 4, it will be observed that the relative positioning of the parts in FIG. 4 is essentially the same as that in FIG. 3 with the exception that the indexing spring 16 is shown in the foreground instead of at the side. This is for illustrative purposes and to explain the functioning of the indexing mechanism. As may be seen best in FIG. 4, the lower end 34 of the indexing spring 16 bears against the surface 35 of the seal plate member 15. It should be noted that the leg 34 of the spring 16 is at an angle such that the upper end 33 of the indexing spring is biased forwardly which is to say clockwise when viewed in the direction of the arrow A. Now, assume that the fluid pressure is cut off at the inlet 47 thereby relieving the pressure holding the discharge head 12 in its upward position. At this point the spring 14 causes the hollow stem 13 and the attached discharge head 12 to move downwardly to the position ultimately shown in FIG. 5. During the downward movement caused by the spring 14, the indexing spring 16 tends to resist downward movement of the head 12 by virtue of the lower end of the spring 34 being engaged against the surface 35. However, because of the angle of the leg 34 the spiral or coil 36 of the spring 16 tends to compress, but in so doing the end 33 moves toward the left in FIG. 4, that is to say, counterclockwise under the bracing effect of the leg 34.

Figure 5:
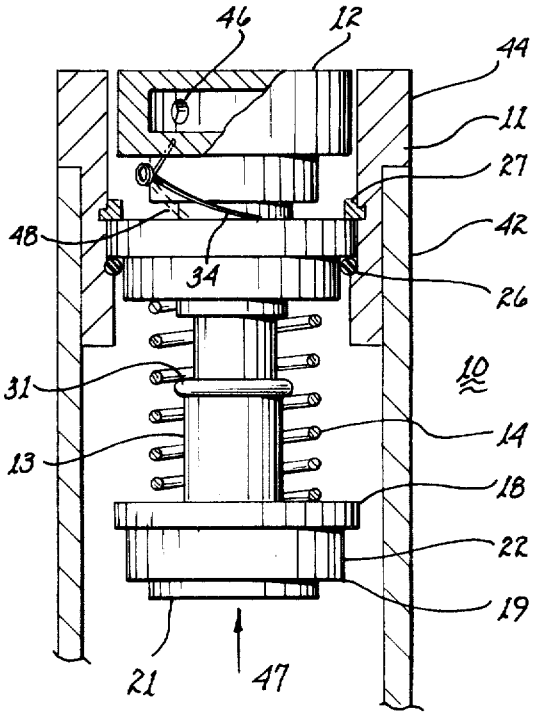
FIG. 5 is a view similar to FIG. 4 but in the stage of operation when fluid pressure is relieved, or absent.

The clockwise rotation of the head 12 is enabled to take place, in part, because of the bearing 19 at the bottom of the hollow stem 13 as may be seen in FIG. 2. That is to say, the spring 14 engaging the annular ring 18 does not prevent rotative movement of the discharge head 12 and the attached hollow stem 13 because of the presence of the bearing 19. Accordingly, under the influence of the presence of indexing spring 16, the discharge head 12 continues to move clockwise until the head 12 is in its lowermost position as seen in FIG. 5. In this position it will be seen in FIG. 5 that the spring 16 is now flattened out or compressed and is exerting a slight upward force against the head 12, but in moving to the position shown, the leg 34 is lying flat, in essence, instead of being, in essence, upright as in FIG. 4. Under the influence of the spring movement resulting in the flattened position of the leg 34 the jet bore 46 of the nozzle head 12 has rotated clockwise from the position seen in FIG. 4 to that seen in FIG. 5. It may be visualized for the moment that the position of FIG. 5 corresponds to the position of FIG. 2 for the particular instance of operation. Then, when fluid pressure is again supplied to the inlet 47 in FIG. 5, the nozzle head will move upwardly to the position shown in FIGS. 3 and 4. Also, in this instance the lower end of the spring 34 will move clockwise slightly because the leg 34 is not braced against movement, but is being relieved of its tension (compression) and thus, the lower end 34 will drag, as it were, to the position shown by the dotted location 48 in FIG. 5. Thus, on the upward movement of discharge head 12 under the application of fluid pressure to inlet 47, the bore 46, in effect, moves directly upwardly and the lower leg 34 of the spring takes a new location. When fluid pressure, however, is again relieved or eliminated so that the spring 14 causes the head 12 to move downwardly, the leg 34 (dotted in FIG. 5) will bite in at the location of the lower leg in the dotted position 48, and in so doing, the head 12 will rotate counterclockwise another notch, so to speak, determined by the dimensions of the spring 16.

Thus, successive turnings on and turnings off of the fluid pressure at the inlet 47 causes the discharge head 12 to index, or rotate, incrementally by the distance determined by the dimensions of the spring 16 and particularly that of the length of the leg 34. Likewise the angularity of the leg 34 is a factor. If the length of the leg 34 is such that the spring is essentially vertical at the start, the indexing movement will be greater. If the length of the leg 34 is short, the extent of the rotative indexing movement will be less. It is not essential that the spring 16 be of the spiral variety. Any biased spring element that can provide a bracing action for the downward movement of the discharge head 12 will suffice, so long as there is a relaxing of that bias when the head is moving outwardly. A straight wire having certain resiliance, or flexibility, with one end attached to the underside, or equivalent, of the head 12 would be sufficient in appropriate instances.

Figure 6:
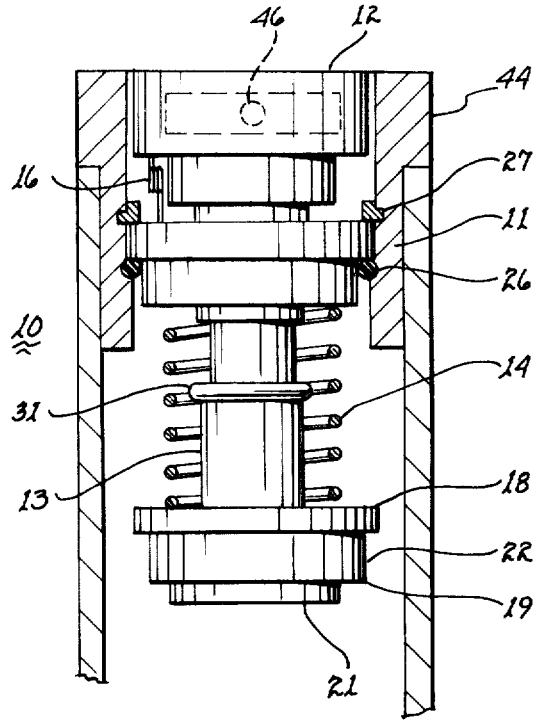
FIG. 6 is a view similar to FIG. 5 at a still later stage in the operation.

In FIG. 6 there is shown the position of the head after the next indexing motion has occurred following the location of the part shown in FIG. 5. Thus, the bore 46 shown at an angle toward the rear in FIG. 5 is shown projecting directly back in FIG. 6 which is to say one additional increment in the clockwise direction. Thus, in FIG. 6 the spring 16 is again shown compressed and at the left hand side of the head 12.

It is important to note that the indexing resilient member, e.g. 16, is radially displaced from the axis of the head 12 and likewise is at an angle to that axis. The length of the member 16, its displacement from axis of rotation, and its angularity to that axis determine the extent of the indexing in each cycle of operation.

Figure 7:
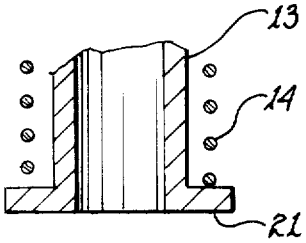
FIG. 7 is a partial view in section illustrating a modified form of the invention.

In FIG. 7 there is shown a modification of the structure illustrated in the preceding figures. In this form the essential difference is that the lower end of the hollow stem 13 has only a flange 21. It does not have a bearing 19. Thus, the spring 14 has its lower end bearing directly against the flange 21. It this form there is a greater resistance to rotation of the hollow stem 13 under the influence of the spiral spring 16. However, parts such as the synthetic material Nylon particularly in the presence of water does not offer too great a resistance to rotation even when a spring, such as 14, bears against one end. Thus, it has been found that rotational indexing will take place with a structure such as that shown in FIG. 7.

Figure 8:
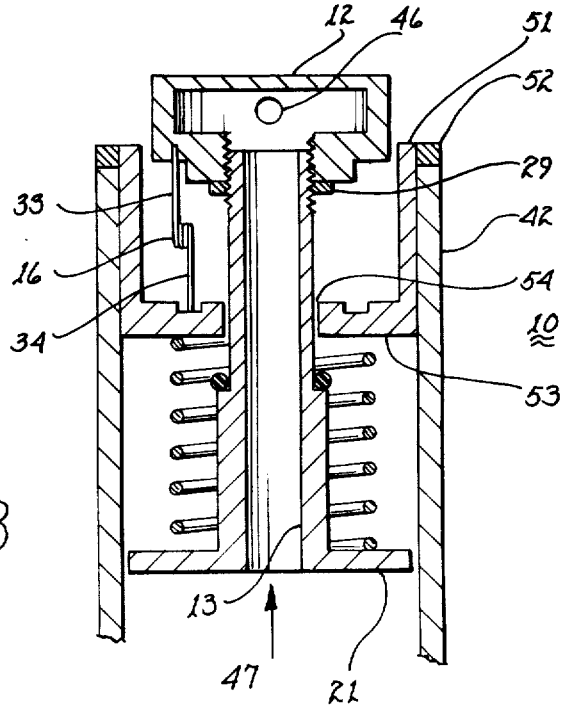
FIG. 8 is a sectional view showing a still further modified form of the invention.

In FIG. 8 there is shown a modification in which a housing 51 corresponding to the housing 11 is held inside of supply or inlet conduit 42 by some kind of a sealing ring 52. The housing 51 includes a lower barrier 53 which can be an integral part of the housing member 51. The barrier 53 includes a central opening 54 through which the hollow stem 13 projects. The remaining portion of the structure shown in FIG. 8 corresponds essentially to that described in connection with the preceding Figures, including that of FIG. 7 where only a flange 21 exists at the bottom of the hollow stem 13. The problem with the structure of FIG. 8 is that once the housing 51 has been disposed in place, as for example, by the sealing ring 43, it is somewhat difficult to remove it and one would not ordinarily want the housing 51 cemented into place so that it can not be removed at all. However, with an appropriate sealing ring 43 the structure will function according to the invention. The operation of the structure shown in FIG. 8 will be according to that described for the preceding Figures.

Also, in all of the Figures the same reference characters are used for corresponding parts.

The indexing produced by the spring 16 is positive for each inward and outward movement of the discharge head and the incremental movement is the same from one operation to the next. Positive and accurate indexing accordingly has been achieved.

While preferred embodiments of the invention have been shown, it will be understood that other embodiments may be devised within the spirit and scope of the invention.

I claim:

1. A rotational indexing nozzle arrangement adapted to be disposed in a conduit for supplying fluid under pressure comprising, a housing having a discharge end and being adapted to be disposed inside of such conduit, said housing including a support member having a central opening and two sides, a hollow stem having first and second ends slidably disposed in said central opening, a discharge head attached to said first end of said hollow stem adjacent the discharge end of said housing, abutment means at said second end of said hollow stem, first spring means between said abutment means and one side of said support member, and rotationally indexing means responsive to motion of said discharge head away from and toward said support member disposed between the other side of said support member and the under side of said discharge head for rotating said discharge head a predetermined amount upon each movement cycle of said discharge head.

2. A rotational indexing nozzle arrangement adapted to be disposed in a conduit for supplying fluid under pressure comprising, a housing having a discharge end and an inlet end adapted to be disposed inside of such conduit, a support member held at its periphery inside of said housing and having a central opening and two sides, a hollow stem having first and second ends slidably disposed in said central opening, a discharge head attached to said first end of said hollow stem adjacent the discharge end of said housing, abutment means at said second end of said hollow stem, first spring means between said abutment means and one side of said support member, and rotationally indexing means responsive to motion of said discharge head away from and toward said support member disposed between the other side of said support member and the under side of said discharge head for rotating said discharge head a predetermined amount upon each movement cycle of said discharge head.

3. The rotational indexing nozzle arrangement according to claim 2 including a bearing having an inner race supported by said abutment means and an outer race engaging the abutment end of said first spring means.

4. The rotational indexing nozzle arrangement according to claim 3 wherein said bearing comprises a ball bearing and a collar is disposed between said outer race and the abutment end of said first spring means.

5. The rotational indexing nozzle arrangement according to claim 2 wherein said first spring means comprises a spiral spring surrounding said hollow stem.

6. The rotational indexing nozzle arrangement according to claim 1 wherein said indexing means comprises a bias creating member radially displaced from the axis of said hollow stem having one end engaged with the underside of said discharge head and having its other end engageable with the discharge side of said support member.

7. The rotational indexing nozzle arrangement according to claim 6 wherein said bias creating member comprises a flexing part angularly disposed relative to the axis of said hollow stem and having a length greater than the space between the underside of said discharge head and the discharge side of said support member in the down position of said hollow stem member.

8. The rotational indexing nozzle arrangement according to claim 7 wherein said flexing part comprises a spiral spring whose ends project angularly to the axis of its spiral and said spiral spring axis is at an angle to the axis of said hollow stem member.

9. The rotational indexing nozzle arrangement according to claim 2 including a first ring seal at the inlet side of said support member and split ring retaining means on the discharge side of said support member, and including a ring seal on said hollow stem for sealing against the inlet side of said support member.

10. The rotational indexing nozzle arrangement according to claim 6 including a retaining member on said hollow stem on the discharge side of said support member.

11. A rotational indexing nozzle arrangement adapted to be disposed in a conduit for supplying fluid under pressure comprising, a discharge head moveable between two positions, one position under the influence of fluid pressure and another position under the influence of spring means when the fluid pressure is relieved, a support member for said discharge head and resilient bias means between said discharge head and said support member for indexing said discharge head responsive to movement thereof in one direction under the influence of said fluid pressure and in the opposite direction under the influence of said spring means upon the relief of said fluid pressure.

* * * * *